US008613512B2

(12) United States Patent
Matsuhashi et al.

(10) Patent No.: US 8,613,512 B2
(45) Date of Patent: Dec. 24, 2013

(54) INK JET RECORDING APPARATUS AND INK JET RECORDING METHOD

(75) Inventors: Kunihiko Matsuhashi, Nagano-ken (JP); Hitoshi Ota, Nagano-ken (JP); Masayuki Momose, Tochigi-ken (JP); Tsuyoshi Sano, Nagano-ken (JP); Takeshi Tanoue, Nagano-ken (JP); Shuichi Koganehira, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 12/884,840

(22) Filed: Sep. 17, 2010

(65) Prior Publication Data

US 2011/0115862 A1 May 19, 2011

Related U.S. Application Data

(63) Continuation of application No. 11/393,009, filed on Mar. 29, 2006, now Pat. No. 7,810,920.

(30) Foreign Application Priority Data

Mar. 29, 2005 (JP) ..... 2005-094826
Mar. 29, 2005 (JP) ..... 2005-094827

(51) Int. Cl.
*B41J 2/01* (2006.01)
*B41J 29/38* (2006.01)
*B41J 3/407* (2006.01)

(52) U.S. Cl.
USPC ..... 347/102; 347/17; 347/106

(58) Field of Classification Search
USPC ..... 347/17, 19, 41, 43, 102, 106
See application file for complete search history.

(56) References Cited

U.S. PATENT DOCUMENTS

| | | | |
|---|---|---|---|
| 4,340,893 | A | 7/1982 | Ort |
| 5,041,846 | A | 8/1991 | Vincent et al. |
| 5,148,186 | A | 9/1992 | Tochihara et al. |
| 6,305,796 | B1 | 10/2001 | Szlucha et al. |
| 6,612,691 | B1 | 9/2003 | Koitabashi et al. |
| 6,783,227 | B2 | 8/2004 | Suzuki et al. |
| 6,854,841 | B1 | 2/2005 | Unter |
| 7,055,945 | B2 | 6/2006 | Yoneyama et al. |
| 7,249,836 | B2 | 7/2007 | Yokoyama |
| 2001/0052920 | A1 | 12/2001 | Matsumoto et al. |
| 2003/0142187 | A1 | 7/2003 | Elgee et al. |
| 2003/0151650 | A1 | 8/2003 | Masuda et al. |
| 2004/0036753 | A1 | 2/2004 | Hirai |
| 2004/0263600 | A1 | 12/2004 | Hoshino |
| 2005/0068396 | A1 | 3/2005 | Ferran |
| 2006/0017767 | A1 | 1/2006 | Matsuzawa et al. |

FOREIGN PATENT DOCUMENTS

| | | |
|---|---|---|
| EP | 0 897 805 A2 | 2/1999 |
| EP | 1 041 126 | 10/2000 |
| EP | 1 424 209 | 6/2004 |

(Continued)

OTHER PUBLICATIONS

Patent Abstract of Japanese No. 2000-229425 Dated Aug. 22, 2000.

(Continued)

*Primary Examiner* — Jannelle M Lebron

(57) ABSTRACT

A recording head is operable to eject ink toward a recording medium. A carriage mounting the recording head is operable to carry the recording head in a first direction. At least one infrared ray heater is provided on the carriage so as to oppose the recording medium. An input energy of the infrared ray heater is 60 W or less.

13 Claims, 3 Drawing Sheets

(56) References Cited

FOREIGN PATENT DOCUMENTS

| | | |
|---|---|---|
| JP | 8-174812 | 9/1996 |
| JP | 10-86353 | 4/1998 |
| JP | 10-323974 | 12/1998 |
| JP | 2000-229425 | 8/2000 |
| JP | 2001-199151 | 7/2001 |
| JP | 2001-270241 | 10/2001 |
| JP | 2002-240411 | 8/2002 |
| JP | 2003-127347 | 5/2003 |
| JP | 2004-050546 | 2/2004 |
| JP | 2004-136489 | 5/2004 |
| JP | 2004-142385 | 5/2004 |
| JP | 2004-195664 | 7/2004 |

OTHER PUBLICATIONS

Patent Abstract of Japan and English Translation of JP 2001-270241 Dated Oct. 2, 2001.

Patent Abstract of Japan and English Translation of JP 2004-050546 Dated Feb. 19, 2004.

English Translation of JP-A-2003-127347 Published May 8, 2003.

English Translation of JP-A-2004-136489 Published May 13, 2004.

English Translation of JP-A-2004-195664 Published Jul. 15, 2004.

INK JET RECORDING APPARATUS AND INK JET RECORDING METHOD

This is a continuation of application Ser. No. 11/393,009 filed on Mar. 29, 2006, now U.S. Pat. No. 7,810,920, claims the benefit thereof and incorporates the same by reference.

BACKGROUND OF THE INVENTION

The present invention relates to an ink jet recording apparatus and an ink jet recording method. Particularly, the invention relates to an ink jet recording apparatus provided with a heater, and to an ink jet recording method performed with respect to coated printing paper having low water absorbability.

An ink jet recording method is a printing method which performs printing by ejecting minute ink droplets from a printing head toward a recording medium, such as paper or the like. Since the ink used in the ink jet recording method is ejected from the printing head, it is necessary for the ink to have low viscosity, and thus ink having high water content is used.

Accordingly, as problems of the ink jet recording method, the occurrence of feathering, the occurrence of bleeding, the drop in density, the degradation in a color developing property, the degradation in fixing property (drying property), and the occurrence of a cockling curl may be exemplified. As a method of resolving theses defects, a thermal drying system is generally suggested.

For example, Japanese Patent Publication No. 2004-142385A discloses an ink jet printer in which a heater is mounted on a head carriage, and a printing surface is heated and dried by a pressure contact roller while performing printing. However, in such an ink jet printer, since the pressure contact roller contacts the printing surface right after performing printing, a blur may occur before being dried.

Japanese Patent Publication No. 10-86353A discloses an ink jet printer in which a rod-shaped halogen heater is disposed on a back face of a printing surface so as to accelerate evaporation. In such an ink jet printer, the quick start is possible by using the halogen heater, but in order to heat the printing surface at the sheet surface temperature of 200° C. for the purpose of completely evaporating a liquid component of ink, a heating process is performed by applying energy of about 200 W on an average. Accordingly, the atmosphere temperature rises, so that even ink in the printing head is dried, which causes clogging. In addition, the temperature of each component rises, a heat radiating mechanism needs to be provided in the printer, which results in an increase of a cost or size.

Japanese Patent Publication No. 10-323974A discloses an ink jet printer in which an infrared ray heater having a specific peak wavelength is disposed on a back face of a carrying path so as to perform a heating process. In such an ink jet printer, in order to improve an efficiency of the infrared ray heater, the distance between the heater surface and the paper surface is set to 0.35 mm (the relatively short distance). Since the temperature of the heater becomes the high temperature of 170° C., paper dust is dropped from the back face of the paper, which may cause a fire. In addition, since the heating is performed from the back face of the printing surface, a drying efficiency is lowered, the printing head is always in a dried state by a hot air, and the clogging occurs.

An ink jet recording method is a printing method which performs printing by ejecting minute ink droplets from a printing head toward a recording medium, such as paper or the like. Since the ink used in the ink jet recording method is ejected from the printing head, it is necessary for the ink to have low viscosity, and thus ink having high water content is used.

On the other hand, dedicated paper having high water absorbability is used as the recording medium to obtain a high quality printed image. However, in order to attain sufficient ink absorption, a coated amount for the ink absorbing layer must be increased. In addition, in order to allow the ink absorbing layer to be transparent, fine powder silica or alumina is used as a raw material, which leads to an increase of a cost. As a result, this increase of a cost becomes an obstacle that restricts a use of a user.

Although common paper such as copy paper or the like is cheap, since it has lower water absorbability than the above dedicated paper, it is not originally appropriate for the recording medium of the ink jet recording method. Various ink has been developed for ensuring a high quality image with respect to the cheap common paper, but it is originally very difficult for the common paper to attain the image quality of the dedicated paper.

As paper cheaper than the common paper such as the copy paper or the like, there is coated printing paper. This coated paper is a composite sheet obtained by coating both faces or one face of the base paper with a coated color being a kind of coating material for the purpose of an improvement of printability. The coated paper is provided for only printing sheet. Since the coated paper is used in a recording method which uses ink having high viscosity and does not require water absorbability, optimization is made in the coated paper such that it is excellent in a fixing property or color developing property. In the coated paper, a thick ink absorbing layer like the above dedicated paper or a high-graded fine particle having high transparency is not necessary. In addition, production facilities are provided so as to meet an active demand of several millions of tons for a year, so that coated paper of a high quality has been supplied very cheaply.

Since the coated paper has water absorbability lower than the common paper, it is not more appropriate than the common paper for the recording medium of the ink jet recording method. However, since the image quality of the coated paper is very high, a technology has been suggested in which the coated paper is used as the recording medium of the ink jet recording method.

For example, Japanese Patent Publication No. 2002-240411A discloses an ink jet recording method in which, after ejecting ink droplets onto an intermediate transfer medium having a transfer layer formed on a base substrate so as to form an intermediate image, the intermediate image is transferred to the transfer layer and the coated paper to obtain a final image. However, according to this technology, since the image is not directly formed on the coated paper but formed using the intermediate transfer medium, a device other than an ink jet printer is further required. That is, since a size of the printer increases and a manufacturing cost of the printer or a printing cost increases, it is not possible to achieve advantages of an ink jet recording method characterized by the simplicity and a small size.

Japanese Patent Publication No. 2001-199151A discloses another technology in which at the same time as ink ejection, an image quality improving liquid having a function for aggregating ink on the paper is sprayed so as to prevent the ink from spreading on the paper, or heat is applied to the paper during printing operation so as to support the drying treatment. However, according to this technology, the spraying of the image quality improving liquid may cause disadvantageous effects. For example, clogging of nozzles may occur due to the mist of the image quality improving liquid. Since a liquid amount on the recording medium may increase in order to spraying of the image quality improving liquid, it may not be possible to suppress bleed from occurring. Further, a dedicated capping system for handling the image quality improving liquid may be necessary.

SUMMARY OF THE INVENTION

It is therefore an object of the invention to provide an ink jet recording apparatus and an ink jet recording method adopting the thermal drying system but being practical.

It is also an object of the invention to provide an ink jet recording method capable of performing high quality printing with respect to coated printing paper having low water absorbability without any additional device.

In order to achieve at least one of the above objects, according to the invention, there is provided an ink jet recording apparatus, comprising:

a recording head, operable to eject ink toward a recording medium;

a carriage, mounting the recording head and operable to carry the recording head in a first direction; and at least one infrared ray heater, provided on the carriage so as to oppose the recording medium, wherein an input energy of the infrared ray heater is 60 W or less.

A plurality of infrared ray heaters may be provided on both side portions of the carriage in the first direction.

A sum of an input energy of each of the infrared ray heaters may be 60 W or less.

The infrared ray heater may be a halogen lamp.

The infrared ray heater may be arranged such that a distance between the infrared ray heater and the recording medium is 20 mm or more.

In order to achieve at least one of the above objects, according to the invention, there is also provided an ink jet recording method, comprising:

providing a recording medium;

disposing a carriage provided with a recording head and an infrared ray heater, so as to oppose the recording medium;

moving the carriage in a first direction; and ejecting ink from the recording head while heating the recording medium with the infrared ray heater, wherein an input energy of the infrared ray heater is 60 W or less.

The ink jet recording method may further comprise:

placing the infrared ray heater at a position not opposing the recording medium at the end of the movement of the carriage in the first direction;

moving the carriage in a second direction opposite to the first direction;

ejecting ink from the recording head while heating the recording medium with the infrared ray heater; and placing the infrared ray heater at a position not opposing the recording medium at the end of the movement of the carriage in the second direction.

The ink jet recording method may further comprise reducing the input energy of the infrared ray heater when the infrared ray heater is placed at the position not opposing the recording medium.

The heating may be performed such that a surface temperature of the recording medium is made higher than 20° C. than a room temperature.

The recording medium may have a water absorbability in which an amount of absorbed water for 20 $msec^{1/2}$ from a contact start, measured by the Bristow method, is 6 $mL/m^2$ or less.

It is found that the above problems can be solved by making the surface temperature of the recording medium higher than 20° C. at most. Therefore, it is enough to provide a heater having such an extent of heating ability. Since the high temperature or high energy is not necessary, the printing head is not dried by a hot air. Therefore, an ink jet recording image of a high quality can be obtained by resolving the above problems.

The above advantages becomes notable in a case where a recording medium having low water absorbability (for example, coated printing paper) is used.

In order to achieve at least one of the above objects, according to the invention, there is also provided an ink jet recording method, comprising:

providing a recording medium having a water absorbability in which an amount of absorbed water for 20 $msec^{1/2}$ from a contact start, measured by the Bristow method, is 6 $mL/m^2$ or less;

disposing a carriage provided with a recording head so as to oppose the recording medium;

moving the carriage in a first direction; and ejecting ink from the recording head, an ejected amount of which is no less than the amount of absorbed water, wherein the ejecting is performed such that a time interval for forming adjacent ink dots in the first direction is no less than a time period for which the ejected amount of ink is absorbed by the recording medium.

The ejected amount of ink may fall within a range from 6.4 $mL/m^2$ to 9.6 $mL/m^2$.

The ejected amount of ink may fall within a range from 7.5 $mL/m^2$ to 8.6 $mL/m^2$.

The time interval may be 0.4 sec with respect to 6 $mL/m^2$ of ink.

The ink may include cyan ink, magenta ink and yellow ink.

The ink may include black ink.

The ink may include red ink and blue ink.

The ink may be pigment ink.

With the above configurations, the ink jet recording apparatus, which has been generally used, can be used as it is without providing additional devices. Further, a high quality image can be obtained by using coated printing paper, which has low water absorbability and excellent printability, as the recording medium.

Further, the ink ejecting amount is about half an amount which is required in forming an image on a recording medium used for conventional ink jet recording (common paper, dedicated paper, or the like). In addition, even though the ink ejecting amount is about the half, a clear image can be formed. Therefore, it is possible to reduce an amount of consumed ink.

According to the invention, there is also provided an image, recorded on the recording medium by the above ink jet recording methods.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE EMBODIMENTS

Embodiments of the invention will be described below in detail with reference to the accompanying drawings.

Figure 1:
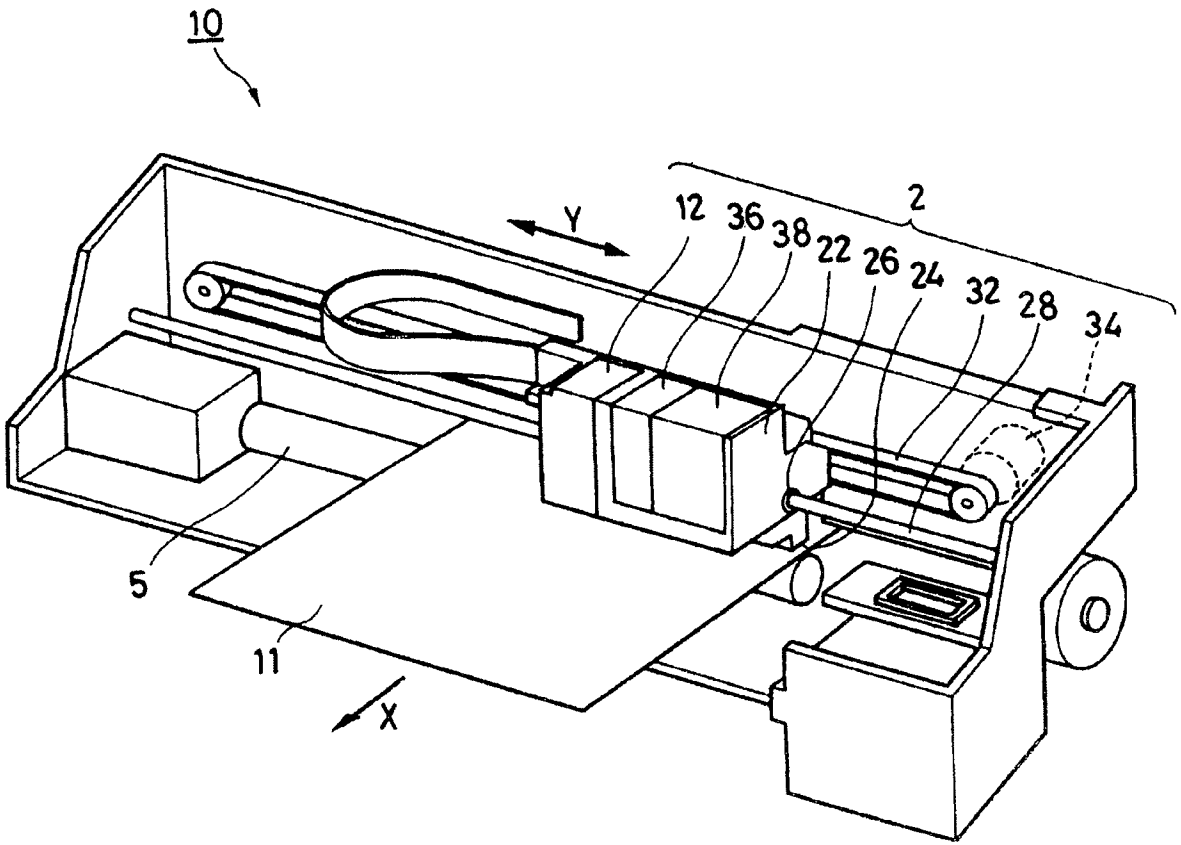
FIG. 1 is a perspective view of an ink jet recording apparatus according to one embodiment of the invention.

As shown in FIG. 1, an ink jet recording apparatus 10 according to one embodiment of the invention comprises a recording section 2. The recording section 2 includes a carriage 22 for mounting an ink cartridge, a recording head 24 for ejecting ink, a shaft hole 26 provided in the carriage 22, and a guide shaft 28 that is inserted into the shaft hole 26 for slidably supporting the carriage 22 in a direction shown by an arrow Y which is substantially perpendicular to a sheet feeding direction of a recording medium 11 such as paper shown by an arrow X. The recording head 24 has a plurality of nozzle orifices which are arrayed in the feeding direction X. The recording section 2 further includes a timing belt 32, a carriage motor 34, a black ink cartridge 36, and a color ink cartridge 38.

In this embodiment, an infrared ray heater 12 is provided in the carriage 22. The recording medium 11 is transported by a transporting roller (not shown) or an ejecting roller 5.

When the carriage motor 34 drives the timing belt 32, the carriage 22 is guided on the guide shaft 38, so that the carriage 22 reciprocally moves in the direction Y. The recording head 24 is mounted on a side of the carriage 22 opposite to the recording medium 11. The black ink cartridge 36 and the color ink cartridge 38 for supplying the ink to the recording head 24 are detachably mounted on the carriage 22.

In this embodiment, when the carriage 22 is slid in the direction Y so as to perform printing, the infrared ray heater 12 is also simultaneously slid in accordance with the slide movement of the carriage 22. Therefore, as the infrared heater 12 is activated, a part of the recording medium 11 being subjected to the recording is heated, and a drying process is accelerated.

Figure 2:
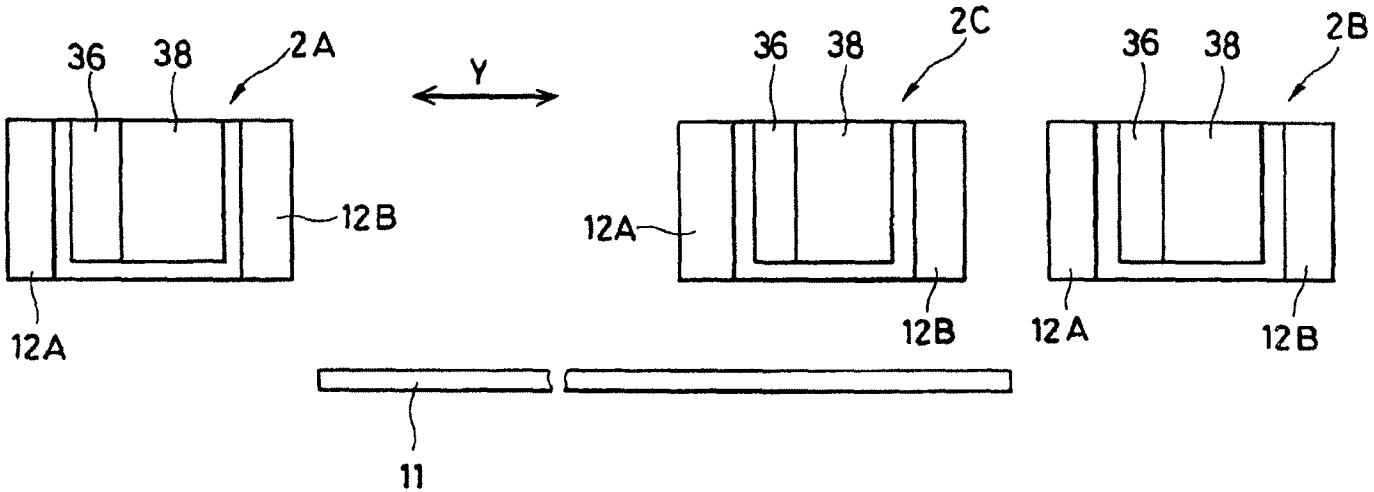
FIG. 2 is a schematic side view showing a movement of a head carriage in the ink jet recording apparatus.

As shown in FIG. 2, a pair of the infrared ray heaters 12A, 12B may be disposed on both side ends the carriage 22. In this case, the infrared ray heaters 12A, 12B are arranged symmetrically with respect to the sheet feeding direction X. If the infrared heater is provided on only one side of the carriage 22, at the time of performing reciprocal recording, there are two cases including a case in which the infrared ray heater passes a position before the ink droplet is landed on the position, and a case in which the infrared ray heater passes a position after the ink droplet is landed on the position, and thus the conditional difference with regard to the ink absorption and drying is generated between the above-mentioned two cases. Arranging the infrared ray heaters 12A, 12B as described the above, such a conditional difference will not be generated.

Input energy of each infrared ray heater is 60 W or less, and preferably 50 W or less. In this embodiment, since the infrared ray heater can be sufficiently used so long as it merely perform a heating assistance, an infrared ray heater whose input energy exceeds 60 W does not need to be provided. Further, if the infrared ray heater whose input energy exceeds 60 W is provided, a heat radiating mechanism is required, so that there is problem in that a size of the printer is increased and a manufacturing cost of the printer is increased.

In a case where a plurality of infrared ray heaters are provided in the carriage 22, it is preferably configured such that a total sum of input energies becomes 60 W or less, and more preferably 50 W or less. As the infrared ray heater, for example, a halogen lamp, and a heating halogen lamp can be used. In addition, as the infrared ray heater, a far infrared ray heater (for example, ceramic heater) can be used. The halogen lamp is preferably used in that a response is fast, a quick start is possible, and the control is easy.

In this embodiment, the infrared ray heaters 12A, 12B are disposed such that a distance between the infrared ray heaters 12A, 12B and the surface of the recording medium 11 is 20 mm or more (preferably, 30 to 45 mm). If the distance is less than 20 mm, ink mist adhesion may occur.

Since the heating process in this embodiment merely serves as a drying assistant, the upper limit of the temperature heating the surface of the recording medium 11 is preferably the temperature higher than the room temperature (for example, 25° C.) by 20° C., more preferably the temperature higher than the room temperature by 15° C., and further more preferably the temperature higher than the room temperature by 10° C. If the surface of the recording medium is heated with the temperature higher than the room temperature by 20° C. or more, the drying of ink in the recording head 24 due to a rise of the atmosphere temperature or the like may be caused. Further, the lower limit of the temperature heating the surface of the recording medium 11 is not particularly limited, but preferably the temperature higher than the room temperature by 5° C.

In this embodiment, irradiation ranges of the infrared ray heaters 12A and 12B are preferably placed outside the recording medium 11 every time when the carriage 22 is scanned in the direction X. That is, as shown in the positions 2A and 2B, the infrared ray heaters 12A, 12B are moved to a position not opposing the recording medium 11. If the scanning direction of the carriage 22 is inversed without placing the irradiation range outside the recording medium 11, a heating time of an end portion of the recording medium 11 may be longer than a heating time of a central portion of the recording medium 11. The position 2C shows a case that the irradiation ranges of the infrared ray heaters 12A, 12B is on the recording medium 11.

In addition, it is preferable to perform a control that the heating energy generated from each of the infrared heaters 12A, 12B is decreased when the irradiation range of each of the infrared heaters 12A, 12B is placed at a position not opposing the recording medium 11. That is, such a control is performed when the scanning direction of the carriage 22 is inversed. Otherwise the heating energy is accumulated in the non-recording section of the ink jet recording apparatus which is generally provided with a capping unit, an ink absorbing member, or the like to perform maintenance operations. Further, since the lifetime of the halogen lamp is rapidly reduced if the halogen lamp is turned on or off, it is preferable that the current inputted to the halogen lamp is reduced to perform the heat energy reduction.

The significant heat assistance effect can be obtained in a case where a recording medium having low water absorbability. Specifically, a recording medium in which an amount of absorbed water for a time of 20 $msec^{1/2}$ from a contact start is 6 $mL/m^2$ or less in the Bristow method.

The Bristow method has most spread as a method of measuring an amount of absorbed liquid for a short time period, and it is adopted by Japan Technical Association of The Pulp and Paper Industry (J'TAPPI). The detailed testing method is described in J'TAPPI No. 51 'Method of testing for liquid water absorbability of paper and paper board'. In addition, at the time of measuring the water absorbability, a head box slit width of Bristow testing is controlled in response to surface tension of ink. The leakage of ink from a back face of paper is excluded from the calculation.

Figure 3:
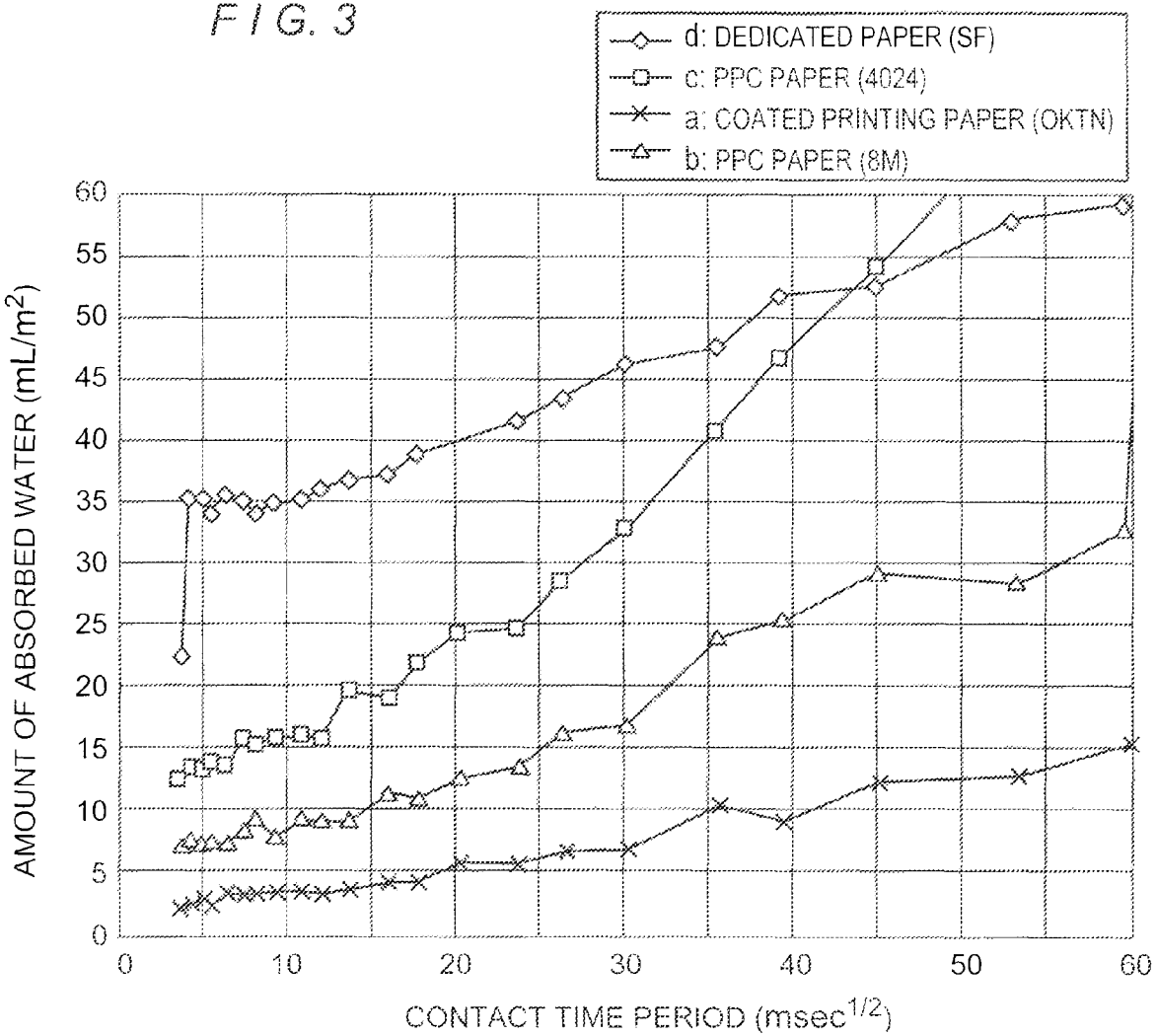
FIG. 3 is a graph showing results of measurement for water absorbabilities of four kinds of paper using the Bristow method.

FIG. 3 is a graph showing results obtained by measuring water absorbability of four kinds of paper by the Bristow method. As in a reference example which will be described in detail below, a line "a" indicates a measured result of water absorbability of coated printing paper (OK Top Coat N; manufactured by Oji Paper Co., Ltd.; hereinafter, referred to as 'OKTN'), a line "b" indicates a measured result of water absorbability of high-quality PPC paper (BM paper; manufactured by Nippon Paper Group, Inc.), a line "c" indicates a measured result of water absorbability of another PPC paper (Xerox Premium Multipurpose 4024; manufactured by Xerox Corporation; hereinafter, referred to as '4024') and a line "d" indicates a measured result of water absorbability of dedicated paper for ink jet recording (Super Fine Paper; manufactured by Seiko Epson Corporation; hereinafter, referred to as 'SF paper').

Further, in the present specification, "an amount of absorbed water for a time of 20 $msec^{1/2}$ from a contact start being not more than 6 $mL/m^2$" means that an accumulated amount of absorbed water for a time from 0 $msec^{1/2}$ of a horizontal axis of FIG. 3 to 20 $msec^{1/2}$ (that is, 0.4 sec: 20 $msec^{1/2}$) does not exceed 6 $mL/m^2$ of a vertical axis.

As apprehended from FIG. 3, only the coated printing paper (OKTN) corresponds to paper which satisfies an essential condition of low water absorbability defined in the present specification, and the other PPC paper and the dedicated paper do not satisfy the essential condition of low water absorbability.

In this embodiment, any coated paper, which has been generally used as printing paper for letterpress printing, planographic printing (for example, offset printing), or intaglio printing (for example, gravure printing), can be used so long as corresponding paper satisfies the above-mentioned essential condition of low water absorbability. This coated paper includes common coated paper, cast coated paper, and matted coated paper.

Specific numeric examples for this embodiment will be described below. However, the invention will not be limited to the examples.

A small halogen lamp of 50 W (JCR3551; manufactured by Iwasaki Electric Co., Ltd) was installed on the carriage 22 of the ink jet recording apparatus 10 (PX-G900; manufactured by Seiko Epson Corporation), and the printing test was carried out. As the recording medium 11, coated printing paper (OKTN) was used. In the coated printing paper, an amount of absorbed water for a time of 20 $msec^{1/2}$ from a contact start was 6 $mL/m^2$ or less in the Bristow method. A water-based pigment ink set (ink set for PX-G4000; manufactured by Seiko Epson Corporation) including four colors (cyan, magenta, yellow, and black) was used as an ink set.

In power input described in Table 1 ('W' of Table 1), a color bleed determining pattern was printed with various duties at 4% intervals, and a maximum value of the duty in which the color bleed is allowable (that is, printing duty value of a limit in which a blur between colors occurs) was measured. The measured result is shown in Table 1.

TABLE 1

| W | Duty |
|---|---|
| 0 | 38% |
| 25 | 38% |
| 34 | 42% |
| 44 | 46% |
| 50 | 50% |

As apprehended from Table 1, it was observed that a duty of about 12% was improved at 50 W. At this time, the temperature of printing surface was 35° C., that is, the normal temperature (25° C.)+10° C.

If the temperature of the printing surface is 10° C., since the circumference within the printer is under the general usage condition, the clogging of nozzles of the recording head and the ink evaporation at the maintenance unit are not considerable. That is, a power is 60 W or less and preferably 50 W or less.

In this embodiment, since a recording medium having low water absorbability is used, the ink is dried and stuck on the recording medium without being almost absorbed in the recording medium. That is, since a colored component contained in the ink is not almost absorbed in the recording medium, there is an advantage in that an ink amount related to color development of an image decreases, compared with the common paper such as PPC paper or the like or dedicated paper for ink jet recording which has been generally used. Since it is difficult for the ink to be absorbed, a time period taken until the ink is dried and stuck on the recording medium grows longer, and it is likely for the expansion of ink dots to be increased on the recording medium. Accordingly, even when the ink dot amount or the number of ink dots per unit area becomes smaller than that of a case of the common paper or the dedicated paper set in the conventional ink jet printer, it is possible to achieve at least the same color developing property as the conventional case.

In this embodiment, an ink ejecting amount is set to at least an amount of absorbed water in the recording medium, that is, set to at least an amount of absorbed water for a time of 20 $msec^{1/2}$ from a contact start. Specifically, it is set to 6 $mL/m^2$ or more, preferably, set within a range of 6.4 to 9.6 $mL/m^2$, and more preferably, set within a range of 7.5 to 8.6 $mL/m^2$. If an ink ejecting amount is not less than 6 $mL/m^2$, a clear image having high printing density is obtained. In addition, if an ink ejecting amount is not more than 9.6 $mL/m^2$, since the ink is completely absorbed in the recording medium, it is difficult for the mutual mixing to be generated between ink dots (hereinafter, referred to as mixed color), so that it is difficult for the bleeding to occur in the image.

As a printing method which satisfies the above-mentioned condition, for example, the following two methods A and B may be exemplified.

Method A: as compared with the conventional ink jet printer, an amount of one ink droplet (hereinafter, it is referred to as an amount of ink dot) is the same amount, but the number of ink dots per unit area is reduced.

Method B: as compared with the conventional ink jet printer, an amount of ink dot is reduced, but the number of ink dots per unit area is the same.

In a case where the printing is performed on a recording medium having low water absorbability by adopting the method A, from a point of view of a drying property or an abrasion-resistant property of ink on the recording medium and of a color developing property or color reproducibility, on the basis of the number of ink dots with respect to the conventional dedicated paper, the number of ink dots may be preferably 30 to 55%, and may be more preferably 35 to 45%. The printing is performed within the above-mentioned range, so that it is possible to obtain at least the same color developing property and color reproducibility as the case in which the printing is performed on the conventional dedicated paper. In addition, a clear image with little bleeding can be obtained on the coated paper of low water absorbability.

In a case where the printing is performed on a recording medium having low water absorbability by adopting the method B, an amount of ink dot with respect to the dedicated paper can be preferably 9.6 $mL/m^2$ or less and can be more preferably 8.6 $mL/m^2$ or less (an amount of ink dot with respect to the conventional dedicated paper is 22 $mL/m^2$). The printing is performed within the above-mentioned range, so that it is possible to obtain at least the same color developing property and color reproducibility as the case in which the printing is performed on the conventional dedicated paper. In addition, a clear image with little bleeding can be obtained on the coated paper of low water absorbability.

In this embodiment, an ejecting time interval between adjacent dots is set to a time that is equal to or longer than an ink absorption allowable time period. Here, the ink absorption allowable time period refers to a contact time period that is necessary for obtaining a predetermined amount of absorbed water ($mL/m^2$) in the Bristow method. For example, as shown by the line "a" of FIG. 3, in the coated printing paper (OKTN), since a contact time necessary for obtaining 6 $mL/m^2$ of the amount of absorbed water is 20 $msec^{1/2}$ (that is, 0.4 sec), an ink absorption allowable time of the coated printing paper (OKTN) is 0.4 sec with respect to ink of 6 $mL/m^2$.

As is explained in connection with the method B, the ink can be ejected from the recording head by properly changing the amount of ink dot, and the ink absorption allowable time can be changed in accordance with the amount of ink dot. According to the result obtained by testing various coated printing paper which satisfies the essential condition of low water absorbability, for example, when the ink ejecting amount is set to 6 $mL/m^2$, if a time interval of 0.3 to 0.5 sec is taken for recording a next ink dot onto an adjacent location after an initial ink dot is recorded, the color mixture between adjacent dots does not occur. In addition, when the ink ejecting amount is set to 7.5 $mL/m^2$, if a time interval of 1.2 to 1.6 sec is taken for recording a next ink dot onto an adjacent location after an initial ink dot is recorded, it was confirmed that the color mixture between adjacent dots does not occur.

In this embodiment, an ink set used in a general ink jet recording method, that is, an ink set including cyan ink, magenta ink, and yellow ink can be used as it is. However, an ink set including black ink is preferably used, and an ink set including a secondary color caused by the color mixture, that is, an ink set including red ink, green ink, and/or blue ink is more preferably used.

In this embodiment, so-called pigment ink is preferably used in which a pigment is used as a colored component of ink. The reason is because when pigment ink is stuck on the recording medium of low water absorbability, solid-liquid separation between a liquid component (a solvent, water, or the like) other than a solid content, such as a pigment or the like contained in the ink, and the solid content rapidly progresses, and a colored component (pigment) related to color developing property of an image effectively exists on a surface of the recording medium. In this case, it is possible to obtain a clear image with a small amount of ink dot or the small number of ink dots per unit area, as compared with the dye ink which has been generally used and in which a dye is used as a colored component.

Specific numeric examples for this embodiment will be described below. However, the invention will not be limited to the examples.

(1) Printing Condition

The printing was performed with respect coated printing paper (OKTN) and dedicated paper for ink jet recording (SF paper; comparative example) by using a dedicated six-color (black, cyan, magenta, yellow, red, and violet) ink set for an ink jet recording apparatus (PX-G5000; manufactured by Seiko Epson Corporation) capable of recording a large dot (7.7 ng/dot), a middle dot (3.2 ng/dot), and a small dot (1.6 ng/dot).

As shown in FIG. 3, the water absorbability measured by the Bristow method (an amount of absorbed water for a time of 20 $msec^{112}$ from a contact start) of the coated printing paper (OKTN) was 6 $mL/m^2$. The water absorbability measured by the Bristow method (an amount of absorbed water for a time of 20 $msec^{1/2}$ from a contact start) of the dedicated paper (SF paper) was 40 $mL/m^2$. An ejecting time interval between adjacent dots was set to 1.6 sec.

(2) Evaluation of Printability

When the printing is performed with respect to the coated paper under a condition that a maximum duty is set to 30%, the obtained Gamut (reproducible color space) was about 580,000.

On the other hand, as to the dedicated paper, it was necessary that the printing be performed with a maximum duty of at least 60% in obtaining the same Gamut. Accordingly, it could be apprehended that a used ink amount could be saved by 30% or more by using the method of the invention.

According to the invention, the ink jet recording apparatus, which has been generally used, can be used as it is without providing additional devices. Further, a high quality image can be obtained by using coated printing paper, which has low water absorbability and excellent printability, as a recording medium.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. An ink jet recording apparatus, comprising:

a recording head, operable to eject ink toward a recording medium;

a carriage, mounting the recording head and operable to carry the recording head in a first direction; and at least one infrared ray heater, provided on the carriage so as to oppose the recording medium, wherein the infrared ray heater is configured to be placed at a position not opposing the recording medium at the end of the movement of the carriage in the first direction, wherein the carriage is configured to be moved in a second direction opposite to the first direction, wherein the infrared ray heater is configured to be placed at a position not opposing the recording medium at the end of the movement of the carriage in the second direction, and wherein an input energy of the infrared ray heater is reduced without turning off the infrared ray heater when the infrared ray heater is placed at the position not opposing the recording medium.

2. The ink jet recording apparatus as set forth in claim 1, wherein the infrared ray heater is a halogen lamp.

3. The ink jet recording apparatus as set forth in claim 1, wherein the infrared ray heater is arranged such that a distance between the infrared ray heater and the recording medium is 20 mm or more.

4. The ink jet recording apparatus as set forth in claim 1, wherein the recording medium has a water absorbability in which an amount of absorbed water for 20 $msec^{1/2}$ from a contact start, measured by the Bristow method, is 6 $mL/m^2$ or less.

5. The ink jet recording apparatus as set forth in claim 1, wherein the input energy of the infrared ray heater is 60 W or less.

6. The ink jet recording apparatus as set forth in claim 1, wherein the input energy of the infrared ray heater is 50 W or less.

7. The ink jet recording apparatus as set forth in claim 1, wherein the input energy of the infrared ray heater is reduced when a moving direction of the carriage is inversed.

8. The ink jet recording apparatus as set forth in claim 1, wherein a plurality of infrared ray heaters are provided on both side portions of the carriage in the first direction.

9. The ink jet recording apparatus as set forth in claim 8, wherein a sum of the input energy of each of the infrared ray heaters is 60 W or less.

10. An ink jet recording method, comprising:

providing a recording medium;

disposing a carriage provided with a recording head and an infrared ray heater, so as to oppose the recording medium;

moving the carriage in a first direction;

ejecting ink from the recording head while heating the recording medium with the infrared ray heater;

placing the infrared ray heater at a position opposing the recording medium at the end of the movement of the carriage in the first direction;

moving the carriage in a second direction opposite to the first direction;

ejecting ink from the recording head while heating the recording medium with the infrared ray heater;

placing the infrared ray heater at a position not opposing the recording medium at the end of the movement of the carriage in the second direction; and reducing an input energy of the infrared ray heater without turning off the infrared ray heater when the infrared ray heater is placed at the position not opposing the recording medium.

11. The ink jet recording method as set forth in claim 10, wherein the heating is performed such that a surface temperature of the recording medium is made higher than 20° C. than a room temperature.

12. The ink jet recording method as set forth in claim 10, wherein the input energy of the infrared ray heater is 50 W or less.

13. The ink jet recording method as set forth in claim 10, wherein the input energy of the infrared ray heater is reduced when a moving direction of the carriage is inversed.

* * * * *